US005850662A

United States Patent [19]

Galvan-Garza

[11] Patent Number: 5,850,662

[45] Date of Patent: Dec. 22, 1998

[54] ELASTIC PLASTIC SCRUBBERS FOR BATHING THE BACK AND THE METHOD OF MANUFACTURE

[76] Inventor: Jesus Javier Galvan-Garza, Platon #799 Col. Contry la Silla, Guadalupe N. L., Mexico, 67170

[21] Appl. No.: 769,803

[22] Filed: Dec. 20, 1996

[51] Int. Cl.[6] ..... A47K 7/02; A47K 7/04

[52] U.S. Cl. ..... 15/222; 15/209.1

[58] Field of Search ..... 15/209.1, 222, 15/223, 224, 229.11, 229.12, 229.13; 601/137, 138

[56] References Cited

U.S. PATENT DOCUMENTS

| | | | |
|---|---|---|---|
| 3,812,849 | 5/1974 | Giunta | 15/222 |
| 3,959,841 | 6/1976 | Horne | 15/222 |
| 5,555,591 | 9/1996 | Chang | 15/222 |
| 5,560,071 | 10/1996 | Chang | 15/222 |

*Primary Examiner*—Terrence Till
*Attorney, Agent, or Firm*—Laurence R. Brown

[57] ABSTRACT

This invention refers to improvements to an elastic plastic scrubber for the bath, which has one or more sections, each one being a tubular element, into which strings or pulls are inserted so that it is possible to rub one's entire back with little effort. A mop placed between two sections retains powdered soap, liquid soap or a tablet of solid soap, in such a way that the person using the scrubber can soap those areas of his body which are normally out of his reach. The method of manufacturing introduces a cylindrical post placed inside an elastic tube that will form the body of the scrubber. At the sides of the post and placed between the body and the post are one or two strings that when stretched out, will reduce the body's length and pleat the same to form a body called a "pumpkin".

2 Claims, 7 Drawing Sheets

ELASTIC PLASTIC SCRUBBERS FOR BATHING THE BACK AND THE METHOD OF MANUFACTURE

BACKGROUND OF THE INVENTION

This invention relates to improvements to an elastic plastic scrubber for the bath and more particularly to a scrubber that comprises in combination a body consisting of one or more tubular sections having inserted strings, straps or pulls as handles, with which it is possible to handle said scrubber in such a way that it is very simple to rub one's back everywhere, without making the effort demanded by the prior art.

For years men have had the necessity to bathe, and for such purpose he has helped himself with different instruments, especially sponges or scoffers that help him in such work.

Many contributions have been made in this field, none of them being capable of rubbing the back in its entirety, without another person's help.

Much time and ingenuity have been invested in order to find the solution to such problem. Finally, after many tests, it was possible to resolve this simple, but at the same time demanding requirement.

Actually there are many scrubbers in the market including some with the evident characteristics of the one disclosed in this application, such patents being issued in different countries. However, such solutions found and patented are very unpractical and in other cases very expensive because of their manufacturing method.

It is therefore the object of this invention to resolve the inconveniences mentioned and at the same time to provide once and for all a scrubber for bathing, which by means of the combination of a central mop (which is one of the features of this invention), provides the possibility of incorporating into the scrubber a portion of solid soap, powdered soap or liquid soap, to improve what is known so far.

DESCRIPTION OF THE INVENTION

The details of this invention are clearly shown in the following description and in the drawings accompanying it as an illustration. Similar reference symbols indicate the same parts in different views.

Referring to said figures the elastic scrubber object of this invention comprises in combination a body (1), that is manufactured of a tubular element of elastic plastic mesh of common knowledge in the prior art.

Figure 1:
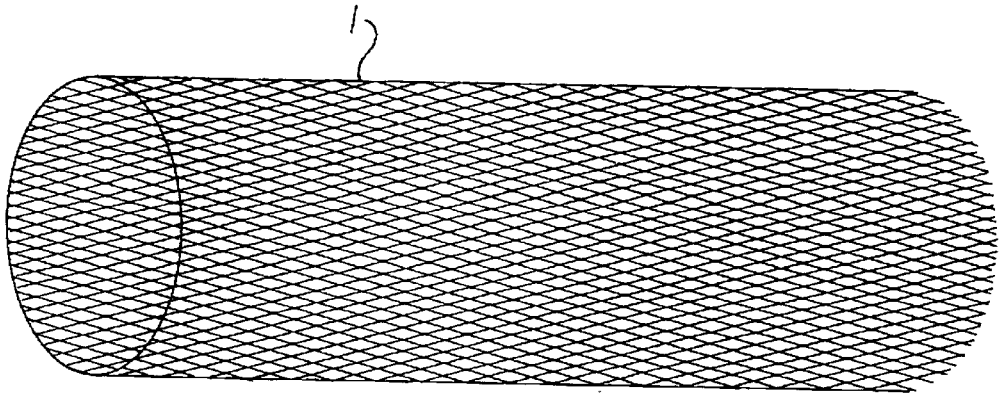
FIG. 1 shows a part of the tubular element of elastic plastic that serves as the structure to manufacture the scrubber.
Figure 2:
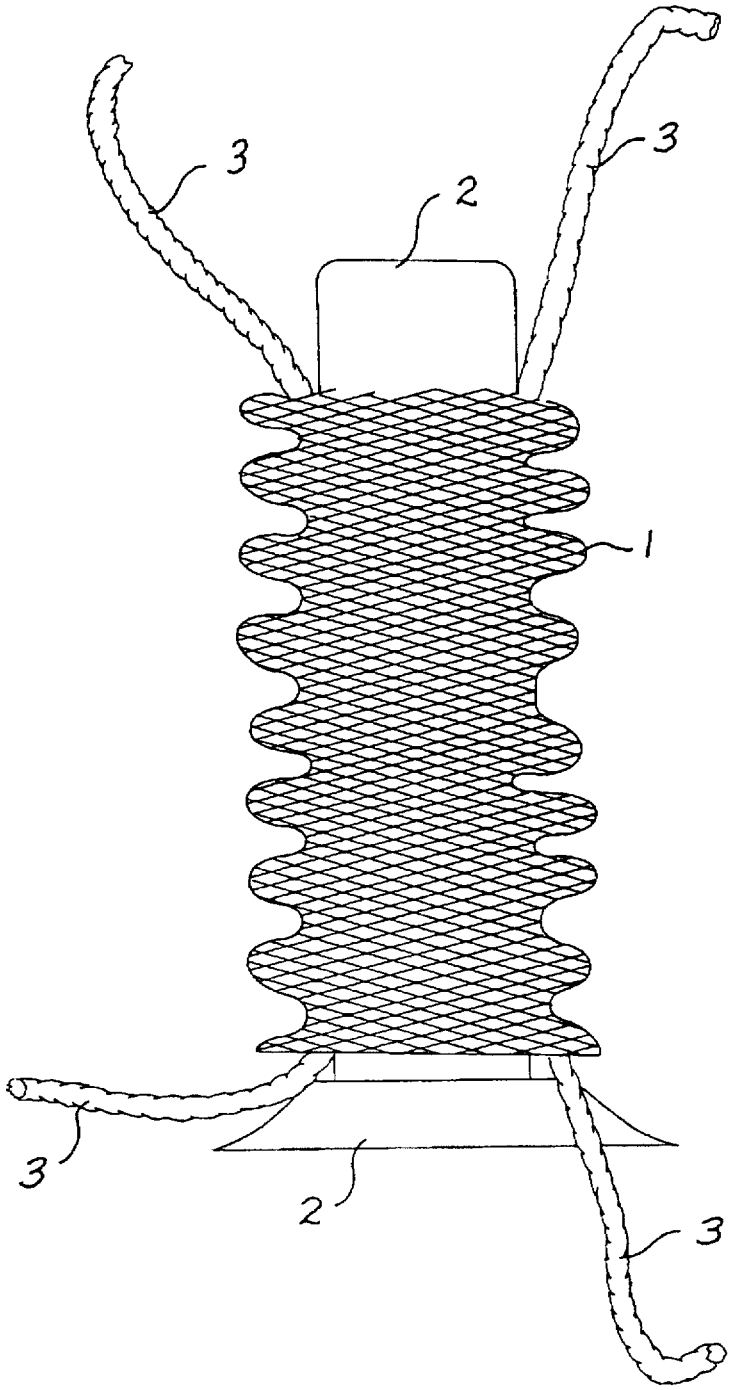
FIG. 2 is an elevation view of the elastic plastic mesh tube placed over the post that serves as a column to pleat the tube, while at its sides there have been placed two strings, which, once the scrubber is formed, will serve as handle-pulls to stretch and operate the scrubber.
Figure 3:
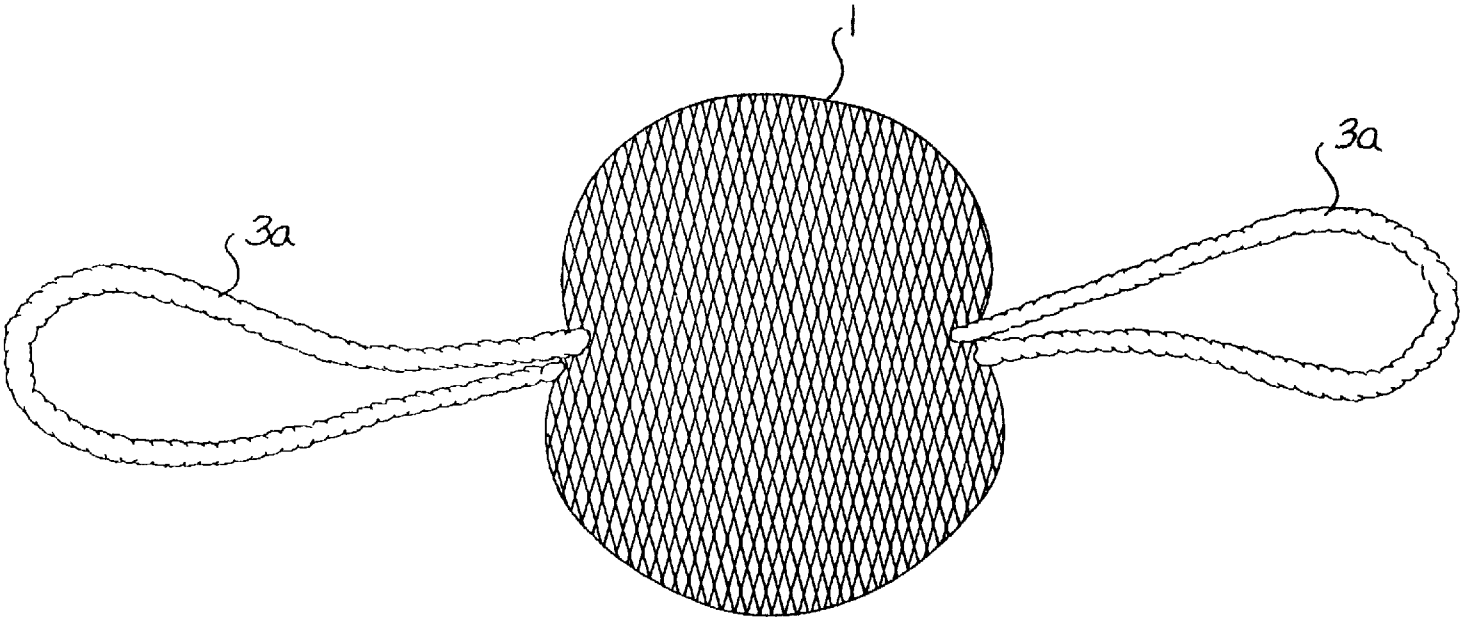
FIG. 3 shows an elevated view of the scrubber of one single section (pumpkin body type), once the scrubber is finished.
Figure 4:
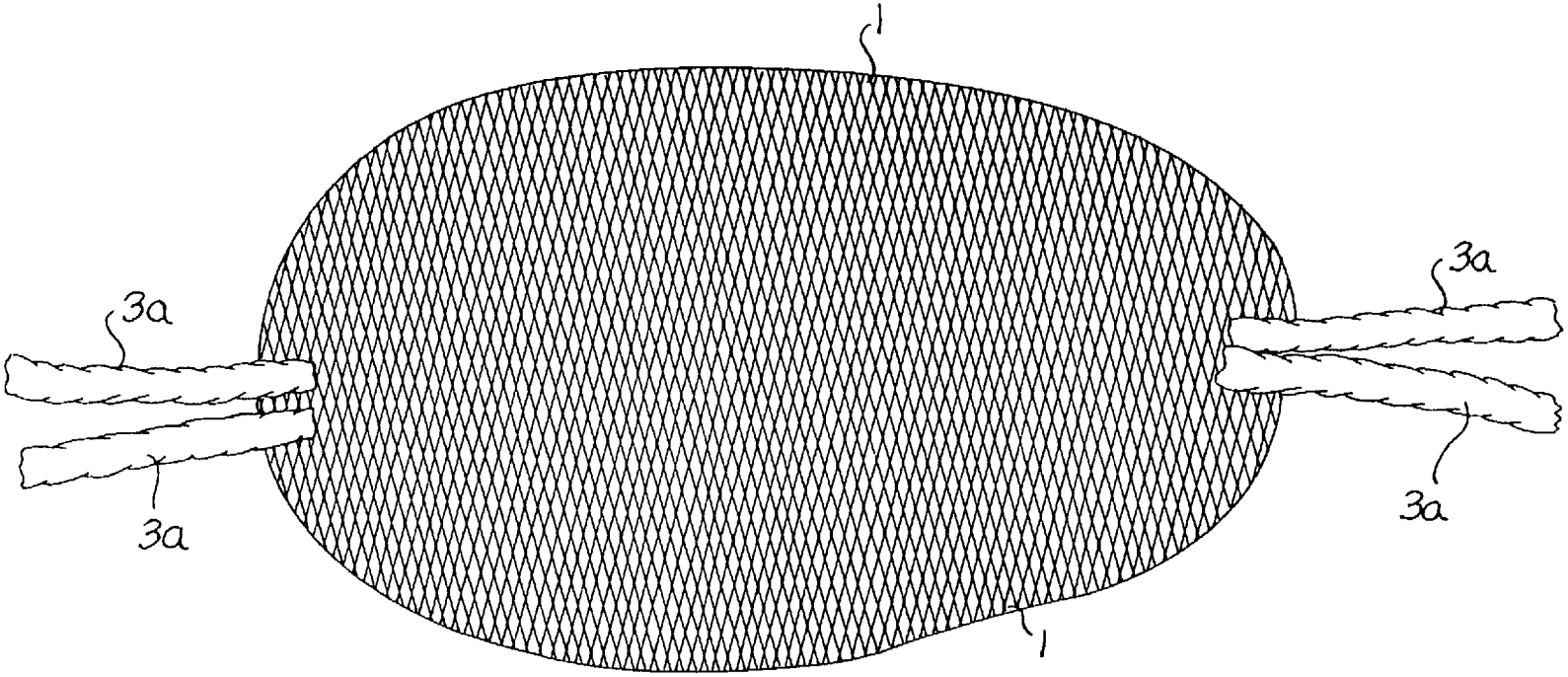
FIG. 4 shows an isometric view of the form the scrubber begins to have once stretching is exerted from its ends by means of the pulls.
Figure 5:
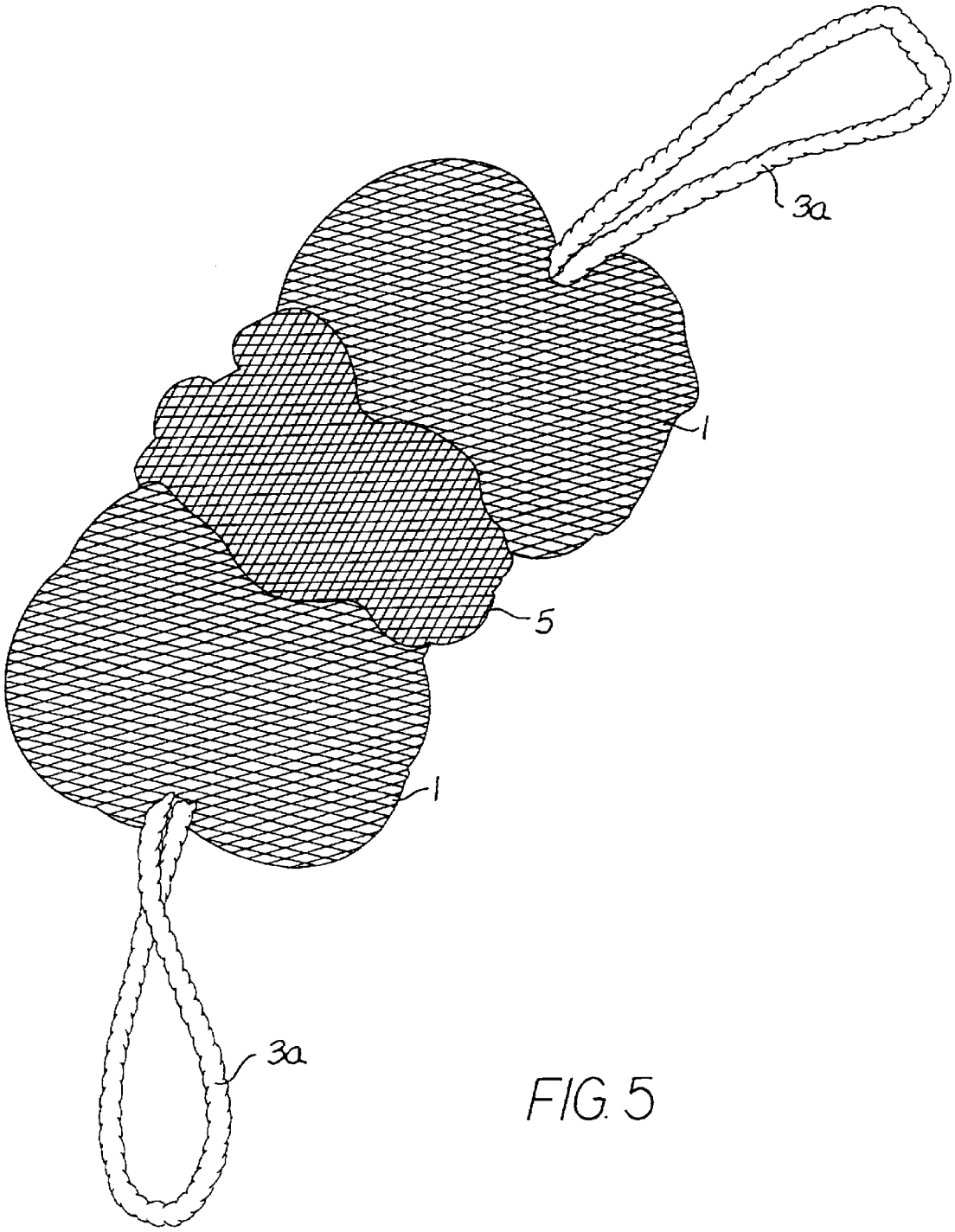
FIG. 5 shows an isometric view of a scrubber formed of two side sections and a central section.
Figure 6:
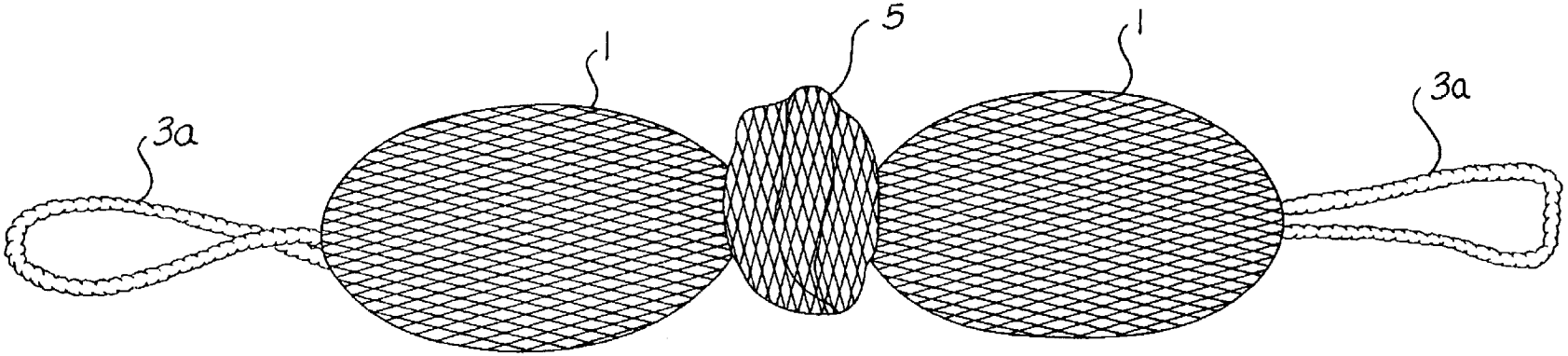
FIG. 6 shows a conventional view of a scrubber formed of two side sections and a mop as that scrubber begins to be pulled from the handles.
Figure 7:
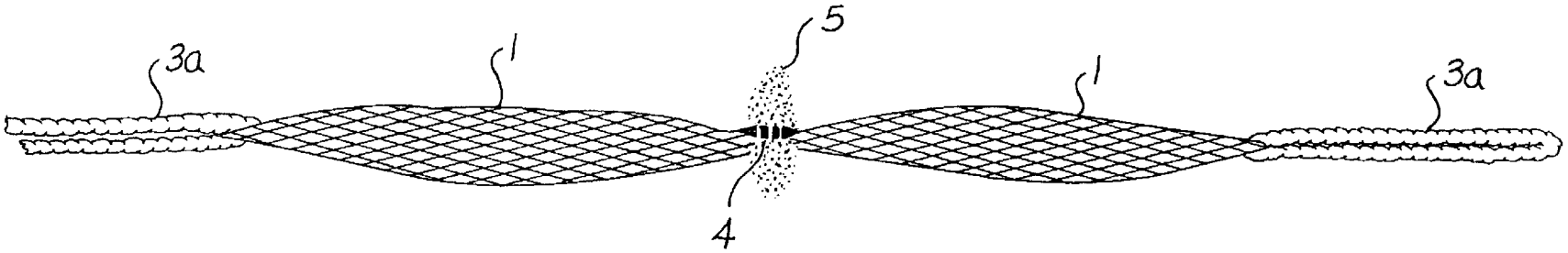
FIG. 7 shows a scrubber completely stretched out.

The manufacturing method consists of placing the elastic plastic mesh tubular element that will form the body (1), on a vertical post (2), in such a way that said post (2) remains inserted in the interior of the body (1) while at the same time, inserting strings (3) between the post (2) and the body (1). These strings will shorten the body (1) length when they are tied, pleating the body (1) which adopts the form of a pumpkin (see FIG. 3).

Once the scrubber has been manufactured it can be used by means of the pulls **(3*a*), that resulted from the strings (3) first inserted into the interior of the body (1) during the manufacturing. When said pulls (3*a*) are stretched out, the body (1)** will lengthen, due to its elastic capacity, allowing use of the scrubber in areas where rubbing or soaping is required.

According to the invention, it is possible to manufacture scrubbers formed by two sections or two bodies (1). For such purpose, at the time of the fabrication, instead of leaving two pulls **(3*a*) to the pumpkin or body (1), two bodies (1) will be joined together by means of a string (4) at the end where the intermediate pull (3*a*) was withdrawn. In such circumstances it is possible to place a mop (5) in the vertex of the union of the bodies (1)**, in such mop it will be possible to place powdered soap, liquid soap or a tablet of solid soap to ease the soaping operation by the person who is using the scrubber.

With the improvements of this invention, it is absolutely easy to rub any part of the body including the back, and at the same timed said areas of the body can be perfectly soaped, a benefit that couldn't be enjoyed with the prior art.

The improvement gotten by the incorporation of the central section (5), which is a mop that retains soap, modifies completely the known art and the state of the art is unquestionably improved.

What is claimed is:

1. A plastic elastic scrubber for bathing the back, comprising in combination:

an elastic plastic mesh tubular element, strings forming two handles, each having two ends extending inside the tubular element from opposite ends and secured to the mesh, said strings being secured to said tubular element when pleated in a manner forming an initial body of reduced length, thereby permitting the tubular element to be elastically lengthened by pulling the two handles apart to provide a scrubber for engaging a users back.

2. A method of manufacturing an elastic back scrubber for bathers, comprising the steps of:

disposing an elastic plastic cylindrical mesh tube about a cylindrical post, inserting from each end of the mesh tube between the tube and the post a pair of strings for forming a handle, pleating the mesh tube about the post, and attaching the strings to the pleats to form a body of reduced length which may be elongated by pulling on the respective handles at each end of the tube.

* * * * *